United States Patent [19]

Schmelzer

[11] 4,239,444

[45] Dec. 16, 1980

[54] POWER SHOVEL

[75] Inventor: Michael Schmelzer, Trier, Fed. Rep. of Germany

[73] Assignee: Gutehoffnungshütte Sterkrade Aktiengesellschaft, Oberhausen, Fed. Rep. of Germany

[21] Appl. No.: 891,029

[22] Filed: Mar. 28, 1978

[30] Foreign Application Priority Data

Mar. 31, 1977 [DE] Fed. Rep. of Germany ..... 2714276

[51] Int. Cl.[3] ..... B66F 9/00

[52] U.S. Cl. ..... 414/685; 37/117.5; 414/697

[58] Field of Search ..... 214/131 R, 140, 138 R, 214/778, 776; 414/681, 685, 686, 697, 694, 695, 715, 713; 37/117.5

[56] References Cited

U.S. PATENT DOCUMENTS

| | | | |
|---|---|---|---|
| 2,529,338 | 11/1950 | Hoover | 414/685 |
| 3,237,790 | 3/1966 | Kampert et al. | 414/697 |
| 3,658,198 | 4/1972 | Keskitalo | 414/697 |
| 3,844,370 | 10/1974 | Belkovicz et al. . | |
| 3,870,171 | 3/1975 | Zimmerman | 414/697 X |
| 3,920,139 | 11/1975 | Nagoshi | 414/697 X |

FOREIGN PATENT DOCUMENTS

| | | |
|---|---|---|
| 875934 | 7/1971 | Canada . |
| 770866 | 3/1957 | United Kingdom . |

*Primary Examiner*—Frank E. Werner

*Attorney, Agent, or Firm*—Toren, McGeady and Stanger

[57] ABSTRACT

A vehicular power shovel having its movable shovel member located forwardly of the front axle thereof is equipped with a toggle lever device and a hydraulic power cylinder mechanism for actuating the shovel member. The shovel member is mounted upon a lift arm structure which is pivotally mounted upon the frame of the apparatus at a point behind the front axle. Both the toggle lever device and the hydraulic power cylinder mechanism are pivotally attached to the frame of the apparatus and are located behind the front axle. The power cylinder operates to actuate the toggle lever device and it is connected thereto at a point other than the buckling joint of the toggle lever. Furthermore, the power cylinder is located rearwardly of the point at which the rear end of the lift arm mechanism is pivotally connected to the frame.

6 Claims, 6 Drawing Figures

POWER SHOVEL

BACKGROUND OF THE INVENTION

The present invention relates generally to relatively heavy power equipment and more specifically to a vehicular power shovel or shovel loader which is wheel-mounted or crawler-mounted and which includes a lift arm carrying the loading shovel member. The invention relates to the type of device wherein the lift arm is raised and lowered by one or more hydraulically operated cylinders.

In mobile power equipment such as shovel loaders which may include lifting cylinders to operate the device, the location of the lifting cylinders may or may not be of importance. In mobile loaders which operate in locations where their mobility is not limited, it is generally not important how the lifting cylinder is arranged on the shovel loader. The lifting cylinders may be arranged so that good transmission of power to lift arms or other similar devices may be insured. In such cases, the lifting cylinders may be arranged either horizontally or almost vertically and they may act either immediately at the lift arm of the vehicle or at webs, plates or similar elements of the lift arm by means of levers which are mounted on a traverse or the like, with the lift arms being supported at the vehicle frame by means of such a traverse. In this connection, reference is made to prior art such as, for example, German patents No. 12 56 585, 12 39 240, and 11 08 140.

When lifting cylinders are arranged horizontally as seen in the axial direction, and are located behind the lift arm webs, the length of the shovel loader will be increased. When the lifting cylinders are located laterally alongside the lift arm web of the apparatus, the width of the vehicle may be significantly expanded. When lifting cylinders are located below or above the lift arm webs, the loading vehicle tends to have its height increased. Accordingly, overall length, width and height of apparatus such as a shovel loader inevitably resulting from the arrangement of the lifting cylinders can be a significant factor and give rise to important disadvantages in the use of the device where the space within which the device may be used is limited. For example, such limitations may become significant when using apparatus in subsurface mining.

In vehicles of the type described, the overall frame of the vehicle may be swivelled somewhere intermediate the front and rear thereof. That is, some shovel loaders include buckling or bending joints whereby the front part of the vehicle frame may be swivelled or pivoted relative to the rear part of the vehicle frame through a joint or connection, with the swivelling action being effected by hydraulic cylinders or the like.

In such vehicles, the arrangement of the overall actuating device utilized for moving the lift arm must usually be contained within a minimum space in the region of the front portion of the vehicle. That is, considering the vehicle from the point of view of the operating direction thereof, it may be required that the entire actuating mechanism be maintained within the region of the front driving and bearing or carrying axle. In this connection reference is made to U.S. Pat. No. 3,844,370.

In other prior art devices it is also known to connect vertical lifting cylinders with the lift arms of the device through toggle lever gearing so that the lift arm is lifted through traction force (see British Pat. No. 770,866). However, in such a device, the overall height and width of the apparatus cannot be reduced since the lifting cylinder is located laterally above the lift arms.

Thus, it is the intent of the present invention to provide a structure and arrangement for a shovel loader which will tend to advantageously minimize the dimensions of the apparatus and which will not unduly complicate the structure or increase the cost of manufacture.

A SUMMARY OF THE INVENTION

Briefly, the present invention may be described as a vehicular power shovel comprising: frame means; means for enabling travel of the vehicle including a front driving and bearing axle for mounting part of said travel means on the front portion of the vehicle, taken relative to the normal direction of travel thereof; a loading shovel member located forwardly of said front axle; lift arm means having said loading shovel supported at one end thereof and having an opposite end pivotally mounted on said frame means at a point rearwardly of said front axle; toggle lever means including an intermediate buckling joint pivotally mounted between said frame means and said lift arm means to transmit power to said lift arm means; and power cylinder means pivotally mounted between said frame means and said toggle lever means for actuating said shovel member through said toggle lever means and said lift arm means. The power cylinder means are pivotally connected with the toggle lever means at a point other than the buckling joint of the toggle lever means. Furthermore, the mounting of the toggle lever means to the frame means is located rearwardly of the front axle. Also located rearwardly of the front axle are the buckling point of the toggle lever means and the connection of the power cylinder means to the toggle lever means. The power cylinder means are, furthermore, located rearwardly of the pivotal mounting of the lift means on the frame means.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF PREFERRED EMBODIMENTS

Figure 1:
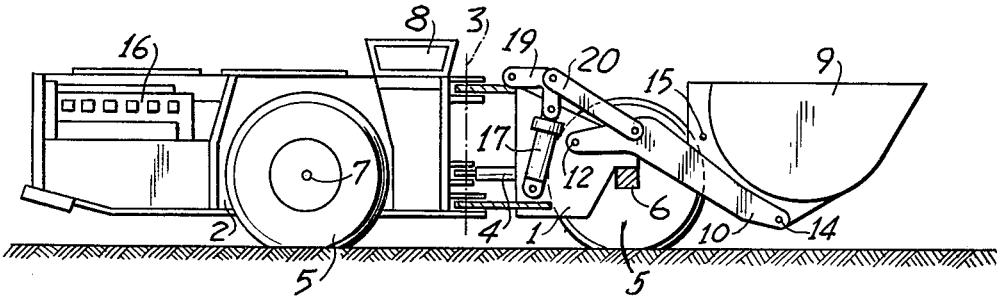
FIG. 1 is a side elevation showing an overall view of a shovel loader assembly utilizing the present invention.
Figure 2:
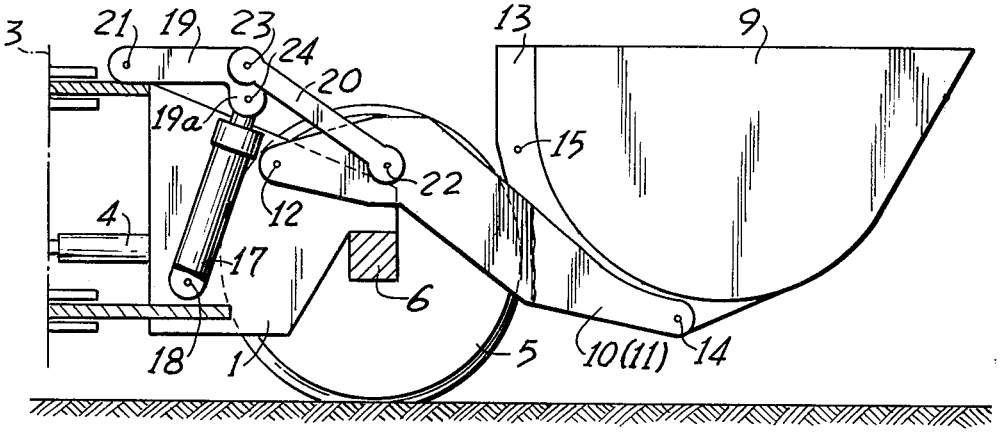
FIG. 2 is an enlarged side elevation of the front portion of the vehicle shown in FIG. 1 and taken along the lines II—II of FIG. 3.
Figure 3:
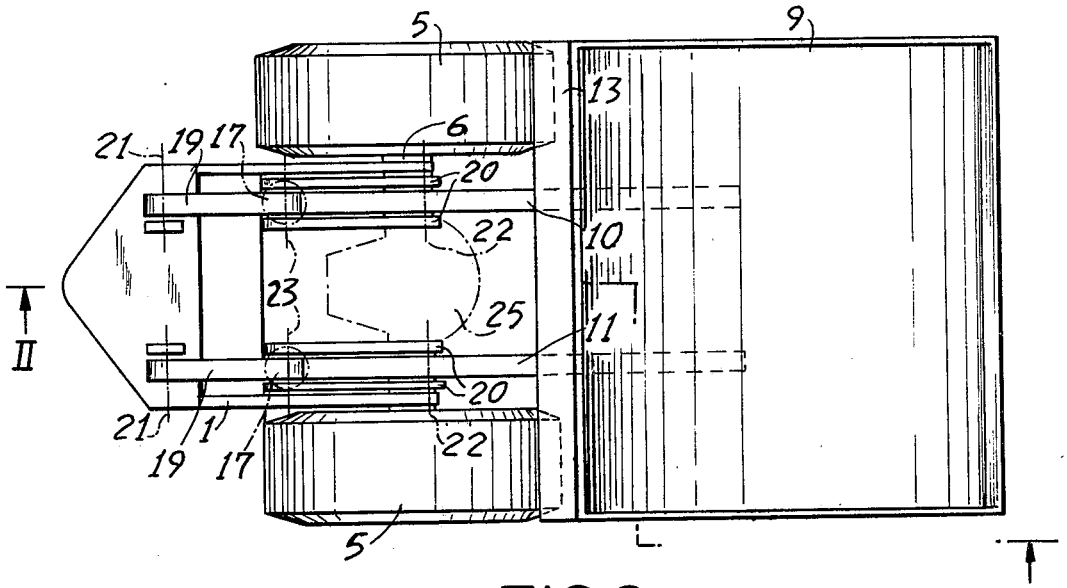
FIG. 3 is a top view of the vehicle shown in FIG. 2.

Referring now to the drawings, wherein like reference numerals are used to refer to similar parts throughout the various figures thereof, there is shown in FIGS. 1–3 a shovel loader or power shovel apparatus essentially comprising a vehicular mechanism having a basic frame assembly mounted upon means, such as wheels or the like, with a shovel member at its forward end. The vehicle itself consists of a frame assembly which includes a front frame 1 and a rear frame 2, these frame parts being pivotally connected to each other through a buckling joint 3 whereby the front frame 1 and the rear frame 2 may be pivotally rotated about the buckling joint 3 and relative to each other. The pivotal movements of the frame operate to enable steering of the vehicle and, accordingly, the vehicle is equipped with steering cylinders 4. The vehicle travels upon wheels 5 having a front axle 6 which carries the front vehicle frame 1, and a rear axle 7 which carries the rear vehicle frame 2. Of course, it will be understood, that crawler-type means may be utilized in place of the wheels to enable travel of the vehicle along a ground surface.

An operator's platform 8 is located between the axles 6, 7. The vehicle also includes a shovel or loading member 9 which is located forwardly of the axle 6. The shovel 9 is supported upon a lift arm assembly which consists of a pair of lift arm webs 10, 11. The lift arm assembly and, consequently, the shovel 9, is pivoted to the front vehicle frame 1 at a pivotal mounting point 12. The shovel member 9 is pivotally mounted to the lift arm webs 10, 11 at points 14 by means of a collar 13 formed upon the loading shovel member 9. The collar 13 has located thereon a tilting power point 15 at which a power cylinder (not shown) may act on the shovel member 9 in order to effect desired tilting or similar movement thereof.

The vehicular power shovel of the present invention also includes a drive mechanism 16 which operates to power the vehicle for movement along a ground surface and which is also adapted for lifting and tilting movement of the shovel member 9. The drive mechanism 16 is arranged in the rear portion of the rear vehicle frame 2.

In the embodiment of FIGS. 1–3, a pair of vertically oriented cylinders 17 are arranged behind the front bearing axle 6 with the cylinders 17 being pivoted to the front vehicle frame 1 at a pivot mounting 18. The cylinders 17 operate to raise and lower the lift arm webs 10, 11 and in order to accomplish this operating feature of the invention, the cylinders 17 are connected to the lift arm webs 10, 11 by means of toggle mechanisms which include a pair of toggle levers 19 and 20 having a buckling or toggle joint connection 23 joining together their proximate ends.

The toggle levers 19 are supported on the vehicle frame 1 at a pivotal support point 21. The toggle levers 20 are pivotally connected to the lift arm webs 10, 11 at pivotal mounting points 22.

It will be found that the lifting cylinders 17 may operate to apply power to effect raising and lowering of the lift arm webs 10, 11 through operation of the toggle lever mechanisms. Since the forces which are applied to the lift arm webs 10, 11 may be simply and easily controlled and may be transmitted thereto through the mechanism of the toggle lever assembly, the lift arm webs 10, 11 may be constructed with a simpler configuration and of lighter material. The toggle levers 19 are formed as angle levers having a short lever part **19*a* which projects downwardly from the buckling joint 23, as best seen in FIG. 2. As a result, the lifting cylinders 17 need not act directly at the buckling joint, as is common with prior art arrangements, but may, instead, be pivoted at a point 24 located on the toggle lever part 19a which projects beyond the buckling joint 23**.

Thus, by extension of the cylinder 17, a force will be applied at the point 24 to cause appropriate movement of the toggle lever mechanism. As will be apparent, contraction of the cylinder 17 will work in a reverse manner.

Because of the fact that the lifting cylinder 17 acts on the toggle lever assembly 19, 20 at a point other than the pivot point of the buckling joint 23, additional force transmission advantages are achieved in the higher lift positions of the lift arm webs 10, 11. These advantages may be obtained without requiring enlargement of the lengths of the lever arms of the toggle levers 19, 20.

All the actuating elements 17, 19 and 20 required for moving the lift arm webs 10, 11, as well as their pivotal and moving points 18, 21, 22, 23 and 24 together with the pivotal point 12 of the lift arm assembly, are all located behind the front bearing axle 6. This arrangement results in an advantageous shifting of the center of gravity and a favorable weight distribution even in situations where the loading shovel member 9 is full of material. The bearing axle 6 is driven through a driving differential 25.

Figure 4:
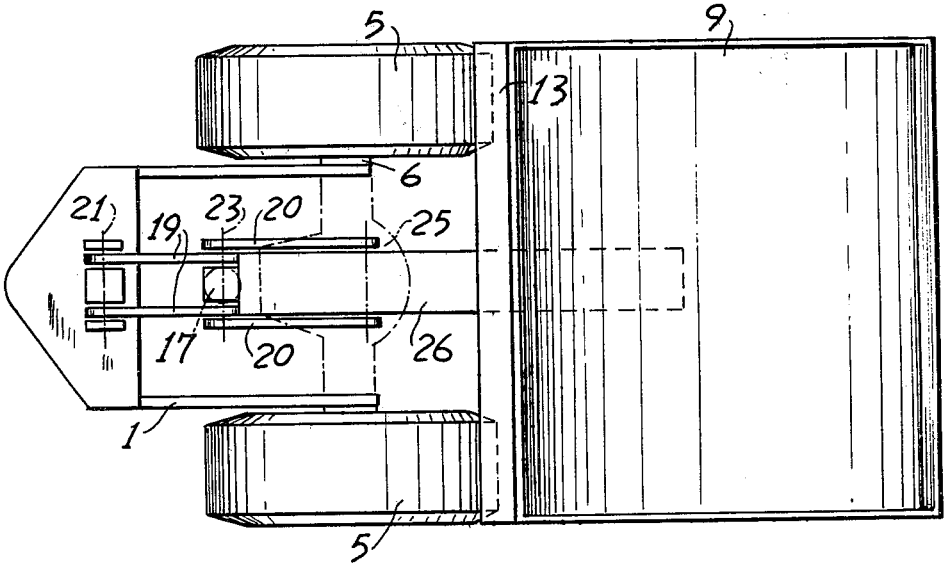
FIG. 4 shows a lifting arrangement or mechanism in a vehicle wherein a lift arm having one lift arm web and one lifting cylinder is utilized.

FIG. 4 depicts a further embodiment of the invention wherein the lift arm assembly is formed to comprise only a single lift arm web 26. In this embodiment, only a single lifting cylinder 17 is provided and the cylinder 17 operates to move the lift arm web 26 through the toggle lever assembly including the levers 19, 20. In the case of the embodiment of FIG. 4, the loading shovel member 9 may be tilted and actuated either through a single cylinder operating to tilt the lift arm web 26 or through a pair of cylinders which may be arranged adjacent to lift arm 26 and which may operate to effect appropriate tilting thereof.

Figure 5:
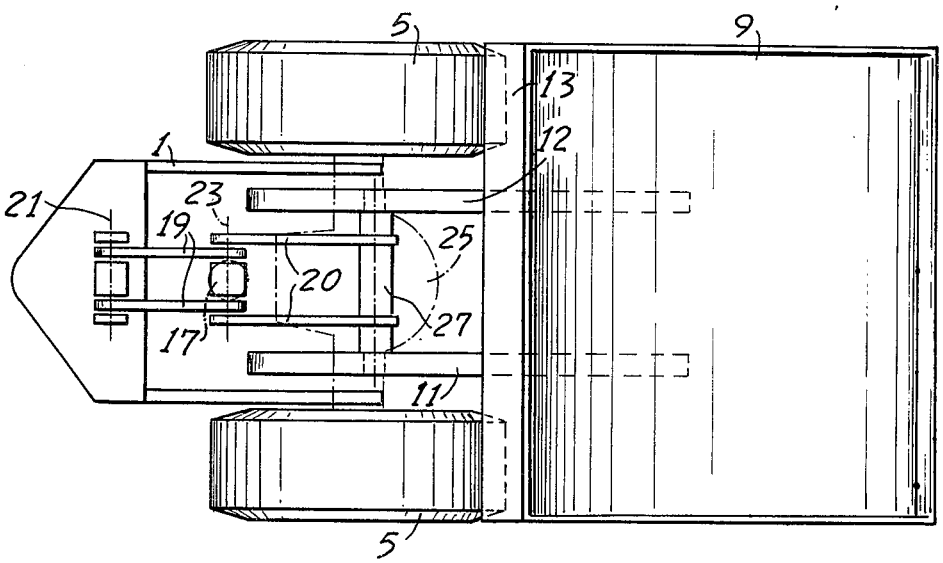
FIG. 5 shows an arrangement wherein several lift arm webs, one lifting cylinder and one toggle lever gearing are provided.
Figure 6:
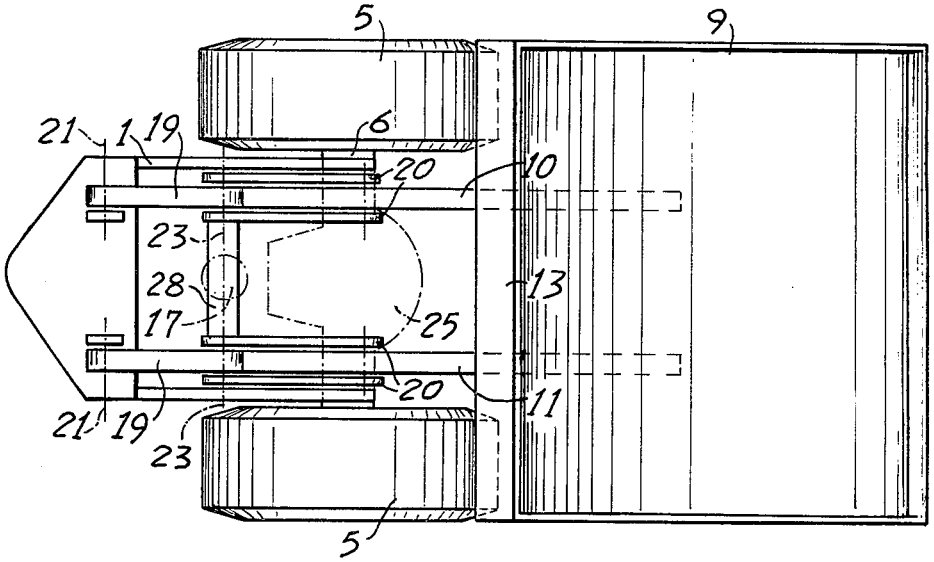
FIG. 6 shows a lifting arrangement for a vehicle having several lift arm webs, one lifting cylinder and several toggle lever gearings.

FIGS. 5 and 6 depict further embodiments of the invention wherein the lift arm assemblies in both embodiments consist of a pair of lift arm webs 10, 11 which are raised by a single cylinder 17, in both cases.

However, in FIG. 5 the toggle lever assembly is formed to include the toggle levers 19, 20 which operate to actuate the lift arm webs 10, 11 through a traverse 27. In the embodiment according to FIG. 6, the lifting cylinder 17 acts upon two toggle levers 19, 20 through a traverse 28 with the two toggle levers 19, 20, in turn, acting upon the lift arm webs 10, 11.

Of course it will be apparent that additional embodiments of the invention other than those depicted and described in the foregoing are also possible. For example, the lift arm assemblies may consist of more than two lift arm webs and more than one lifting cylinder. Furthermore, one toggle lever assembly may be assigned to each lift arm web.

While specific embodiments of the invention have been shown and described in detail to illustrate the application of the inventive principles, it will be understood that the invention may be embodied otherwise without departing from such principles.

What is claimed is:

1. A vehicular power shovel particularly suitable for underground use within limited available space comprising:

a front vehicle section and a rear vehicle section;

means pivotally interconnecting said front and rear vehicle sections together to enable relative pivotal movement therebetween about a substantially vertical pivot axis;

said front vehicle section being located forwardly of said rear vehicle section taken relative to the normal direction of travel of said power shovel;

front frame means contained in said front vehicle section;

drive means including a front axle located in said front vehicle section;

a loading shovel member located forwardly of said front axle;

lift arm means having said loading shovel supported at one end thereof and having an opposite end pivotally mounted on said front frame means at a point rearwardly of said front axle;

toggle lever means including an intermediate buckling joint pivotally mounted between said front frame means and said lift arm means to transmit power to said lift arm means, said toggle lever means being connected to said front frame means at a point rearwardly of said pivotal mounting of said opposite end of said lift arm means to said front frame means; and power cylinder means pivotally mounted between said front frame means and said toggle lever means for actuating said shovel member through said toggle lever means and said lift arm means;

said power cylinder means being pivotally connected with said toggle lever means at a point other than said buckling joint located rearwardly of said pivotal mounting of said opposite end of said lift arm means to said front frame means;

with each of said mounting of said toggle lever means to said front frame means, said buckling joint of said toggle lever means, and said connection of said power cylinder means to said toggle lever means being all located rearwardly of said front axle;

said power cylinder means, including said pivotal connection thereof to said toggle lever means and to said front frame means, being located rearwardly of said pivoted mounting of said lift arm means on said front frame means.

2. A power shovel according to claim 1, wherein said lift arm means comprise a pair of web arms.

3. A power shovel according to claim 2, wherein said power cylinder means comprise a pair of power cylinders and wherein said toggle lever means comprise a pair of toggle levers, said pair of power cylinders and said pair of toggle levers acting, respectively, one each on each of said pair of web arms.

4. A power shovel according to claim 3, wherein said power cylinders are arranged in alignment with the direction of the axes of said lift arm webs.

5. A power shovel according to claim 1, wherein said lift arm means comprise a single central lift arm web and wherein said power cylinder means comprise a single power cylinder, said power cylinder being arranged in alignment with the direction of an axis of said lift arm web.

6. A power shovel according to claim 1, wherein said lift arm means comprise a pair of lift arm webs and wherein said power cylinder means comprises a single power cylinder, said power shovel further including a traverse, said single lifting cylinder being arranged centrally between said pair of lift arm webs and acting on said lift arm webs through said toggle lever means and said traverse.

* * * * *